US009919774B2

(12) United States Patent
Cook et al.

(10) Patent No.: US 9,919,774 B2
(45) Date of Patent: Mar. 20, 2018

(54) SYSTEMS AND METHODS FOR TREATMENT OF LNG CARGO TANKS

(75) Inventors: Jonathan W. Cook, Houston, TX (US); Mark K. Lane, Key Largo, FL (US)

(73) Assignee: Excelerate Energy Limited Partnership, The Woodlands, TX (US)

( * ) Notice: Subject to any disclaimer, the term of this patent is extended or adjusted under 35 U.S.C. 154(b) by 888 days.

(21) Appl. No.: 13/697,939

(22) PCT Filed: May 19, 2011

(86) PCT No.: PCT/US2011/037228

§ 371 (c)(1),
(2), (4) Date: Jan. 30, 2013

(87) PCT Pub. No.: WO2011/146763

PCT Pub. Date: Nov. 24, 2011

(65) Prior Publication Data

US 2013/0118185 A1 May 16, 2013

Related U.S. Application Data

(60) Provisional application No. 61/346,683, filed on May 20, 2010.

(51) Int. Cl.

| | |
|---|---|
| ***F17C 7/02*** | (2006.01) |
| ***B63B 27/34*** | (2006.01) |
| ***B63B 27/24*** | (2006.01) |
| ***B63B 25/16*** | (2006.01) |

(52) U.S. Cl.
CPC ..... *B63B 27/34* (2013.01); *B63B 25/16* (2013.01); *B63B 27/24* (2013.01)

(58) Field of Classification Search
CPC ..... F17C 1/002; F17C 3/025; F17C 13/082; F17C 2270/0102; F17C 2270/0105
See application file for complete search history.

(56) References Cited

U.S. PATENT DOCUMENTS

| | | | |
|---|---|---|---|
| 2,795,937 | A | 6/1957 | Sattler et al. |
| 2,938,359 | A | 5/1960 | Cobb, Jr. et al. |
| 2,940,268 | A | 6/1960 | Morrison |

(Continued)

FOREIGN PATENT DOCUMENTS

| | | |
|---|---|---|
| AU | 2012209046 A1 | 9/2013 |
| CN | 2451873 | 10/2001 |

(Continued)

OTHER PUBLICATIONS

International Search Report.*

(Continued)

*Primary Examiner* — Frantz Jules
*Assistant Examiner* — Brian King
(74) *Attorney, Agent, or Firm* — Frederic Dorwart, Lawyers PLLC; Penina Michlin Chiu

(57) ABSTRACT

Systems and methods for gas-up and cool down of LNG cargo tanks are described herein. A system includes a supply vessel located at a waterway location, a receiving vessel moored to the supply vessel, and a manifold conduit. The supply vessel is configured to transfer natural gas to the receiving vessel using the manifold conduit for gas-up and cool down of one or more LNG cargo tanks onboard the receiving vessel.

7 Claims, 4 Drawing Sheets

(56) References Cited

U.S. PATENT DOCUMENTS 2,975,607 A 3/1961 Bodle
3,034,309 A 5/1962 Muck
3,068,659 A 12/1962 Marshall, Jr.
3,177,936 A 4/1965 Walker
3,197,972 A 8/1965 King
3,350,876 A 11/1967 Johnson
3,362,898 A 1/1968 Van Kleef
3,438,216 A 4/1969 Smith
3,535,885 A 10/1970 Frijlink et al.
3,561,524 A 2/1971 Satterwaite et al.
3,724,229 A 4/1973 Seliber
3,755,142 A 8/1973 Whipple, Jr.
3,834,174 A 9/1974 Stumbos
3,850,001 A 11/1974 Locke
3,864,918 A 2/1975 Lorenz
3,886,887 A 6/1975 Cunningham et al.
3,897,754 A 8/1975 Jerde
3,974,794 A 8/1976 Kakitani et al.
3,975,167 A 8/1976 Nierman
3,978,663 A 9/1976 Mandrin et al.
3,986,340 A 10/1976 Bivins, Jr.
4,033,135 A 7/1977 Mandrin
4,036,028 A 7/1977 Mandrin
4,040,476 A 8/1977 Telle et al.
4,041,721 A 8/1977 Kniel
4,043,289 A 8/1977 Walter
4,106,424 A 8/1978 Schuler et al.
4,170,115 A 10/1979 Ooka et al.
4,202,648 A 5/1980 Kvamsdal
4,219,725 A 8/1980 Groninger
4,224,802 A 9/1980 Ooka
4,231,226 A 11/1980 Griepentrog
4,255,646 A 3/1981 Dragoy et al.
4,292,062 A 9/1981 Dinulescu et al.
4,315,407 A 2/1982 Creed et al.
4,329,842 A 5/1982 Hoskinson
4,331,129 A 5/1982 Hong et al.
4,338,993 A 7/1982 Fernstrum
4,402,350 A 9/1983 Ehret et al.
4,408,943 A 10/1983 McTamaney et al.
4,417,878 A 11/1983 Koren
4,429,536 A 2/1984 Nozawa
4,464,904 A 8/1984 Steigman
4,519,213 A 5/1985 Brigham et al.
4,557,319 A 12/1985 Arnold
4,622,997 A 11/1986 Paddington
4,632,622 A 12/1986 Robinson
4,716,737 A 1/1988 Mandrin
4,718,459 A * 1/1988 Adorjan ..... 405/172
4,819,454 A 4/1989 Brigham et al.
4,867,211 A 9/1989 Dodge et al.
4,881,495 A 11/1989 Tornare et al.
4,924,822 A 5/1990 Asai et al.
4,998,560 A 3/1991 Le Devehat
5,154,561 A 10/1992 Lee
5,375,580 A 12/1994 Stolz et al.
5,400,588 A 3/1995 Yamane et al.
5,457,951 A 10/1995 Johnson et al.
5,564,957 A 10/1996 Breivik et al.
5,762,119 A 6/1998 Platz et al.
5,990,272 A 11/1999 Yamamoto et al.
6,003,603 A 12/1999 Breivik et al.
6,079,222 A 6/2000 Fetescu et al.
6,089,022 A 7/2000 Zednik et al.
6,089,028 A 7/2000 Bowen et al.
6,116,031 A 9/2000 Minta et al.
6,164,247 A 12/2000 Iwasaki et al.
6,250,244 B1 6/2001 Dubar et al.
6,298,671 B1 10/2001 Kennelley et al.
6,336,316 B1 1/2002 Fujii et al.
6,367,258 B1 4/2002 Wen et al.
6,367,429 B2 4/2002 Iwasaki et al.
6,374,591 B1 4/2002 Johnson et al.
6,434,948 B1 8/2002 Eide et al.
6,435,124 B1 8/2002 Williams
6,460,350 B2 10/2002 Johnson et al.
6,519,944 B2 2/2003 Smith
6,546,739 B2 4/2003 Frimm et al.
6,578,366 B1 6/2003 Christiansen et al.
6,598,408 B1 7/2003 Nierenberg
6,637,479 B1 10/2003 Eide et al.
6,644,041 B1 11/2003 Eyermann
6,659,703 B1 12/2003 Kirkley
6,688,114 B2 2/2004 Nierenberg
6,805,598 B2 10/2004 Goldbach
6,816,669 B2 11/2004 Zimmer et al.
6,829,901 B2 12/2004 Harley et al.
6,832,875 B2 12/2004 Bliault et al.
6,851,994 B2 2/2005 Boatman et al.
6,886,611 B2 5/2005 Dupont et al.
6,910,435 B2 6/2005 Hadcroft et al.
6,973,948 B2 12/2005 Pollack et al.
6,976,443 B2 12/2005 Oma et al.
6,979,147 B1 12/2005 Wille et al.
7,073,457 B2 7/2006 Boatman
7,080,673 B2 7/2006 Pollack et al.
7,107,925 B2 9/2006 Wille et al.
7,219,502 B2 5/2007 Nierenberg
7,293,519 B2 11/2007 Montgomery et al.
7,293,600 B2 11/2007 Nierenberg
7,299,760 B2 11/2007 Boatman et al.
7,308,863 B2 12/2007 de Baan
7,318,319 B2 1/2008 Hubbard et al.
7,478,975 B2 1/2009 Hubbard et al.
7,484,371 B2 2/2009 Nierenberg
7,484,404 B2 2/2009 Thompson et al.
7,543,613 B2 6/2009 Adkins et al.
7,644,676 B2 1/2010 Jung et al.
7,681,511 B2 3/2010 Breivik et al.
7,726,358 B2 6/2010 Hartono et al.
7,726,359 B2 6/2010 Hartono et al.
7,793,605 B2 9/2010 Poldervaart et al.
8,141,645 B2 3/2012 Poldervaart et al.
8,181,662 B2 5/2012 Pollack et al.
8,186,170 B2 5/2012 Boatman et al.
8,448,673 B2 5/2013 Danaczko et al.
2002/0073619 A1 6/2002 Perkins et al.
2002/0134455 A1 9/2002 Emblem et al.
2004/0261681 A1 12/2004 Jordanger
2005/0115248 A1 6/2005 Koehler et al.
2005/0254901 A1 11/2005 Lovie
2006/0048850 A1 3/2006 Espinasse
2006/0053806 A1* 3/2006 Tassel ..... B63B 25/16 62/48.1
2006/0081166 A1 4/2006 Montgomery et al.
2006/0156744 A1* 7/2006 Cusiter ..... B63B 25/16 62/50.2
2007/0144184 A1 6/2007 Wijingaarden et al.
2007/0175377 A1 8/2007 Olsen
2007/0214804 A1 9/2007 Hannan et al.
2007/0267061 A1* 11/2007 Ravndal ..... B08B 17/04 137/15.04
2007/0277534 A1 12/2007 Nierenberg
2008/0110091 A1 5/2008 Perkins et al.
2008/0148740 A1 6/2008 Hartono et al.
2008/0153369 A1 6/2008 Hartono et al.
2008/0156244 A1 7/2008 Montgomery et al.
2008/0190117 A1* 8/2008 Lee et al. ..... 62/47.1
2008/0236703 A1 10/2008 Adkins et al.
2009/0272126 A1 6/2009 Matthews et al.
2009/0193780 A1* 8/2009 Faka ..... 60/39.5
2010/0000252 A1 1/2010 Morris et al.
2010/0012009 A1 1/2010 Montgomery et al.
2010/0074692 A1 3/2010 Ehrhardt et al.
2010/0229573 A1 3/2010 Ehrstrom
2010/0263389 A1 4/2010 Bryngelson et al.
2011/0066290 A1 3/2011 Le Devehat et al.
2011/0232767 A1 5/2011 Liem et al.

FOREIGN PATENT DOCUMENTS

CN 2515185 10/2002
DE 2717135 A1 10/1978
DE 3225299 1/1984

(56) References Cited

FOREIGN PATENT DOCUMENTS

| | | | |
|---|---|---|---|
| EP | 0048316 | | 3/1982 |
| EP | 1120596 | A1 | 8/2001 |
| GB | 2007832 | A | 5/1979 |
| GB | 2216972 | A | 10/1989 |
| GB | 2367049 | A | 3/2002 |
| GB | 2406887 | A | 4/2005 |
| JP | 52010910 | | 1/1977 |
| JP | 52010911 | | 1/1977 |
| JP | 53115666 | | 10/1978 |
| JP | 53126003 | | 11/1978 |
| JP | 54022404 | | 2/1979 |
| JP | 54136413 | | 10/1979 |
| JP | 54136414 | | 10/1979 |
| JP | 55020321 | A | 2/1980 |
| JP | 55025659 | | 2/1980 |
| JP | 56015801 | | 2/1981 |
| JP | 56074190 | | 6/1981 |
| JP | 58005598 | | 1/1983 |
| JP | 59166799 | | 9/1984 |
| JP | 60-149599 | | 10/1985 |
| JP | 61-024697 | | 2/1986 |
| JP | 61038300 | | 2/1986 |
| JP | 62141398 | | 6/1987 |
| JP | 6376700 | | 5/1988 |
| JP | 1069898 | | 3/1989 |
| JP | 5332499 | | 12/1993 |
| JP | 06-173710 | | 6/1994 |
| JP | 11125397 | | 5/1995 |
| JP | 9014869 | | 1/1997 |
| JP | 11-117766 | | 4/1999 |
| JP | 11148599 | | 6/1999 |
| JP | 11-208574 | | 8/1999 |
| JP | 2000-062665 | | 2/2000 |
| JP | 2001-206282 | | 7/2001 |
| JP | 2001263592 | | 9/2001 |
| JP | 2002-501861 | A | 1/2002 |
| JP | 2005-104200 | | 4/2005 |
| JP | 2007-534556 | | 11/2007 |
| JP | 2008-519221 | A * | 6/2008 |
| KR | 20060130825 | A | 12/2006 |
| KR | 100676615 | B1 | 1/2007 |
| KR | 10-0730701 | | 6/2007 |
| WO | 99/38762 | A1 | 8/1999 |
| WO | 9947869 | | 9/1999 |
| WO | 01/103793 | | 1/2001 |
| WO | 01/34460 | A1 | 5/2001 |
| WO | 030604245 | | 8/2003 |
| WO | 2005032942 | A1 | 4/2005 |
| WO | 2006/020107 | A2 | 2/2006 |
| WO | 2009/073383 | A1 | 4/2009 |
| WO | 2009071591 | A2 | 6/2009 |
| WO | 2009/087237 | A2 | 7/2009 |
| WO | 2010069910 | A1 | 6/2010 |

OTHER PUBLICATIONS

JP 2008-519221 Translation.*

Zednik, "Shipboard Regasification Terminal," Hydrocarbon Engineering, Oct. 1998, 3 pages.

Bottomley, Leslie, FLNG Key to Global Energy Supply, Offshore, vol. 62, issue 10, Oct. 1, 2002, 3 pages.

Van Wijngaarden, Wim et al., Loading and Offloading of LNG in Open Seas, Overview, Gastech Doha, 2002, 1 page.

Lane, Mark K., Ship-to-Ship LNG Transfer, Sep. 28, 2009, Information Sheet, Recepient and Location Unknown, 11 pages.

Janssens, Patrick, Energy Bridge: The World's First LNG Offshore Solution, Paper for Presentation at Gastech, 2005, 19 pages.

Baldwin, John, Excelerate Energy—Offshore LNG Teesside GasPort and Beyond, Presentation at Safety & Loss Prevention and Oil & Natural Gas Subject Group (SONG), England, Jun. 2008, 18 pages.

Bryngelson, Robert, Gulf Gateway Energy Bridge: The World's First Offshore LNG Receiving Terminal, Presentation, Arendal, Norway, APL Technology Conference, Jul. 29, 2005, 22 pages.

Bryngelson, Robert, Lessons Learned from Permitting, Building, and Operating The Gulf Gateway Energy Bridge Deepwater Port, Presentation at Oil & Gas IQ Conference, Costa Mesa, CA Sep. 14, 2005, 25 pages.

Bryngelson, Robert, North American Terminal Progress Reports, North American Projects: Overview, issues Encountered, and Lessons Learned, Presentation at Houston, TX, May 18, 2006, 22 pages.

Bryngelson, Robert, Market Access and Flexibility Afforded by Excelerate Energy's Technology Infrastructure, Presentation at 12th International Gas Summit, Location Unknown, Oct. 18, 2007, 8 pages.

Bryngelson, Robert, Northeast Gateway Deepwater Port and Other Developments at Excelerate, Presentation at Platts 6th Annual Liquefied Natural Gas Conference, Houston, TX, May 22, 2007, 16 pages.

Bryngelson, Robert, LNG Global Market Dynamics: Entry Points, Flexibility, and Optionality, Presentation, 22nd Annual European Autumn Gas Conference, Oct. 2007, 6 pages.

Bryngelson, Robert, Speed to Market: Expansion of Excelerate's Network and Asset Base and Direction for the Next Decade, Presentation, Atlantic Basin LNG: The Next Decade, Palm Beach, Florida, Nov. 8, 2007, 14 pages.

Byngelson, Robert, Presentation to the Federal Energy Regulatory Commission, Dec. 1, 2007, 30 pages.

Bryngelson, Robert, New Developments and Advances in the LNG Industry: Excelerate Energy's Perspective, Presentation at Houston Producers Forum, Jan. 15, 2008, 19 pages.

Bryngelson, Robert, Floating Liquefaction: Excelerate Energy's Advantage, Presentation, Location Unknown, Feb. 2008, 17 pages.

Bryngelson, Robert, Creating a Flexible LNG Trading Model from the Ground (or Sea) Up, Presentation at Gastech 2008, Bangkok, Mar. 11, 2008, 15 pages.

Bryngelson, Robert, Changing Patterns of the LNG Trade, Presentation at 13th International Gas Summit, Le Meridien Etoile Hotel, Oct. 22, 2008, 9 pages.

Bryngelson, Robert, Flexible Offshore and Dockside Facilities, Presentation at Platt's 8th Annual Liquefied Natural Gas Conference, Feb. 27, 2009, 12 pages.

Bryngelson, Robert, Excelerate Energy Corporate Overview, Presentation to Congressman Kevin Brady 8th District of Texas, Apr. 24, 2009, 19 pages.

Bryngelson, Robert, Excelerate Energy Booth Receiption, Presentation at Gastech 2009, Abu Dhabi, U.A.E., May 26, 2009, 15 pages.

Bryngelson, Robert, Excelerate Energy Corporate Overview, Presentation at World Gas Conference, Buenos Aires, Argentina, Oct. 2009, 31 pages.

Cook, Jonathan, et al., Presentation to U.S. Department of Commerce, SABIT Group Program Liquefied Natural Gas Storage and Transport for Russia, Aug. 31, 2006, 72 pages.

Eisbrenner, Kathleen, on Board Regasification Implications for Security of Supply, Presentation at CERA LNG Summit, Houston, TX, Feb. 12, 2007, 32 pages.

Eisbrenner, Kathleen, Preparing for Short and Long Term Arbitrage Opportunities: Bringing Continents of Energy Together Energy Bridge, Presentation at CWC Sixth Annual World Lng Summit, Rome, Italy, 2005, 18 pages.

Ewans, Kevin, et al., Oceanographic and Motion Response Statistics for the Operation of a Weathervaning LNG FPSO, Proceedings of OMAE '03: 22nd International Conference on Offshore Mechanics and Artic Engineering, Cancun, Mexico, Jun. 8-13, 2003, 7 pages.

Excelerate Energy Limited Partnership, Excelerate Energy Northeast Gateway and Gulf Gateway Deepwater Port Update, Presentation at Northeast Energy and Commerce Assocation 11th Annual Conference on Natural Gas Issues, Boston, MA, Sep. 19, 2005, 13 pages.

Excelerate Energy Limited Partnership, LNG Ship-To-Ship Transfer, Presentation at SIGTTO, Location Unknown, Nov. 18, 2005, 21 pages.

(56) References Cited

OTHER PUBLICATIONS

Excelerate Energy Limited Partnership, Breaking the Traditional Model: Bringing Continents of Energy Together Energy Bridge, Presentation at CWC Sixth Annual World LNG Summit, Rome, Italy, 2005, 12 pages.
Han, Hans Y.S. et al., Design Development of FSRU from LNG Carrier and FSPO Construction Experiences, Offshore Technology Conference, Houston, Texas May 6-9, 2002, 8 pages.
Lakey, Robert, The Teesside GasPort Project, Presentation, Unknown Location, Jan. 23, 2007, 54 pages.
Lane, Mark, LNG Ship-To-Ship Transfer, Presentation to Orkney Harbour Authority, Scapa Flow, Scotland, Dec. 4, 2006, 50 pages.
Lane, Mark, Ship-To-Ship Transfer: LNGC Excalibur—EBRV Excelsior, Presentation at Scapa Flow, Scotland, Feb. 8-10, 2007, 13 pages.
Lane, Mark, LNG Ship-To-Ship Transfer, Presentation at KNPC, Kuwait, Sep. 2, 2007, 97 pages.
Lane, Mark, LNG Ship-To-Ship Transfer, Presentation at SIGTTO 9th Pan American Regional Forum, Nov. 7, 2007, 65 pages.
Lane, Mark, LNG Ship-To-Ship Transfer, Presentation to Fendercare, Abu Dhabi, UAE, Nov. 14, 2008, 69 pages.
Lane, Mark, LNG Ship-To-Ship Transfer, Presentations at Scapa Flow, Kirkwall and Orkney Islands, Scottland, Jan. 29, 2009, 69 pages.
Lane, Mark K., Ship-to-Ship Transfer: Bahia Blanca Gasport, Presentation to KNPC, Kuwait, Nov. 12, 2007 & Feb. 5, 2008, 97 pages.
Lane, Mark K., LNG Ship-To-Ship Transfer, Presentation at Stasco, Antwerp, Mar. 25, 2008, 70 pages.
Lane, Mark K., Ship-to-Ship Transfer: K-Line LNG Shipping, Presentation, London, Dec. 18, 2008, 83 pages.
McDonald, David, et al., Comprehensive Evaluations of LNG Transfer Technology for Offshore LNG Development, LNG 14 Conference, Doha, Qata, Mar. 19-24, 2004, 24 pages.
Scott, Edward, et al., Offshore Value Chain Optimization, Offshore Technology Conference, Houston, Texas, May 4-7, 2009, 17 pages.
Scott, Edward, et al., Offshore LNG Value Chain Optimization, Presentation at Offshore Technology Conference, Houston, Texas, May 7, 2009, 29 pages.
Young, Paul C., et al., LNG STS—A Reality, Presentation at Global LNG Shipping Symposium, Sep. 19, 2006, 63 pages.
Excelerate Energy, LLC, Excelerate Energy Announces Successful Delivery of First LNG Cargo to South America's First-Ever LNG Import Facility, Jun. 9, 2008, Press Release, The Woodlands, TX and Buenos Aires, Argentina, 2 pages.
Shell, Dubai to Build LNG Regasification Terminal and Appoints Shell As Advisor and Main LNG Supplier, Press Release, Apr. 20, 2008, 1 page.
Standy Import Terminals: Right Technology, Right Time, Mar. 25, 2009, Zeus Liquefied Natural Gas Report, Zeus Virtual Energy Library, 1 page.
Floating LNG Plants can be Built, Marine Talk Website, Mar. 15, 2001, 2 pages.
Boylston, Concept Proposal for the Transportation and Regasification of Liquid Natural Gas, 1996, 13 pages.
California Coastal Commission, Offshore LNG Terminal Study, Sep. 15, 1978.
Northeast Gateway Energy Bridge, L.L.C., Application to the U.S. Maritime Administration and the U.S. Guard for the Construction of the Northeast Gateway Deepwater Port, Jun. 13, 2005, 148 pages.
SUEZ LNG NA, Neptune, Date Unknown, 3 pages.
EMCO WHEATON, "Quick release system for bottom loading arms (Pneumatic)". Taken from http://www.emcowheaton.com/en-en/products/safety_release_systems/pneumatic/ as uploaded Nov. 17, 2008.
Translation by Samuel James Henderson "English Translation of Korean Patent No. 10-0676616", translation dated Jan. 23, 2014, 13 pages.
Translator Unknown, Partial English Translation of Japanese Patent No. 6376700, translation dated Mar. 5, 2014, 1 page.
Intellectual Property Office of Singapore, "Invitation to Respond to Written Opinion" for Singapore Patent Application No. 201207871-3, dated Jan. 29, 2014, 9 pages.
IP Australia, "Patent Examination Report No. 1" for Australia Patent Application No. 2011255490, dated Sep. 1, 2014, 3 pages.
IP Australia, "Notice of Acceptance" for Australia Patent Application No. 2011255490, dated Jul. 10, 2015, 2 pages.
Hungarian Intellectual Property Office, "Written Opinion" for Singapore Patent Application No. 201207871-3, dated Jan. 16, 2014, 7 pages.
Intellectual Property Office of Singapore, "Examination Report" for Singapore Patent Application No. 201207871-3, dated Sep. 25, 2014, 12 pages.
International Preliminary Report on Patentability for PCT Application No. PCT/US2011/037228, dated Sep. 5, 2012, 5 pages.
Kanon Loading Equipment, "Kanon Marine Loading Systems". Taken from http://www.brasten.com/media/productBrochure/KANON_Loading_Arms1.pdf, Google cached date of Mar. 16, 2007, 7 pages.
Japanese Patent Office, Japan Platform for Patent Information, Machine Translation of Japanese Patent Application Publication 2002-501861 A, 47 pages.
Patent Office of the Cooperation Council for the Arab States of the Gulf, "(1st) Examination Report" for GC 2011-18446, dated Jan. 28, 2016, 4 pages.
Patent Office of the Cooperation Council for the Arab States of the Gulf, "(2nd) Examination Report" for GC 2011-18446, dated Jun. 23, 2016, 4 pages.
EMCO WHEATON, "Marine Loading Arms", taken from http://www.emcowheaton.com/marine-loading-arms/, Date unknown, 12 pages.
European Patent Office, "Supplementary European Search Report" for EP Application No. 11784269.0 dated May 23, 2017, 8 pages.

* cited by examiner

SYSTEMS AND METHODS FOR TREATMENT OF LNG CARGO TANKS

BACKGROUND

1. Field of the Invention

Embodiments of the invention described herein pertain to the field of shipboard transportation of liquefied natural gas ("LNG"). More particularly, but not by way of limitation, one or more embodiments of the invention describe systems and methods of gas-up and cool down of LNG cargo tanks located in a waterway location.

2. Description of the Related Art

Natural gas is often carried onboard special cryogenic tanker ships from the location of its origin to the location of consumption. In this way, natural gas may be transported to areas with a higher demand for natural gas. Since LNG occupies only about 1/600th of the volume that the same amount of natural gas does in its gaseous state, liquefying the natural gas for transport facilitates the transportation process and improves the economics of the system. LNG is produced in onshore liquefaction plants by cooling natural gas below its boiling point (−259° F. (−162° C.) at ambient pressures). The LNG may be stored in cryogenic cargo tanks located on special cryogenic tanker ships, either at or slightly above atmospheric pressure. Typically, the LNG will be regasified prior to its distribution to end users.

In a conventional cryogenic cargo cycle, tanks on a cryogenic tanker ship are full of fresh air which allows maintenance on the tank and pumps. For example, the tanks are full of fresh air when the cryogenic tanker ship comes out of the yard, after dry docking or repairs, if the ship has been sitting idle, or has burned off all of the remaining natural gas in the take (for example, burning off a heel). The cryogenic cargo cannot be loaded directly into the tanks until the fresh air (for example, oxygen) is replaced with an inert gas to inhibit explosions within the tanks. The tanks may be filled with inert gas (for example, carbon dioxide) until the atmosphere in the tanks contains less than 4% oxygen. Carbon dioxide, however, freezes at temperatures used to store liquefied natural gas, thus the carbon dioxide must be removed prior to filling the tanks with liquefied natural gas. To remove the carbon dioxide from the tanks and the tanks conditioned to receive a cold fluid, the tanks under go a gas-up and cool down procedure.

The cryogenic tank ship is docked at a port and connected to a gas-up and cool down system that includes cryogenic loading arms (hard arms) and/or rigid pipe suitable for handling cryogenic fluids. During gas-up, the inert gas atmosphere in the cargo tanks and piping systems of the cryogenic tanker ship is displaced with natural gas. Next, the cargo tanks are cooled down by slowly reducing the temperature of the cargo tank atmosphere and surrounding containment to temperatures of about −140° C. Once the cargo tanks are cooled, LNG may be loaded into the cargo tanks without subjecting the tanks to cold shock. The gas-up and cool down operation takes approximately 34 to 72 hours before the LNG cargo may be loaded onto the cryogenic tank ship.

During the gas-up and cool down operation, the portion of the dock involved in the operation is not available for shipping operation (for example, unloading and loading LNG, and/or the use of liquefaction trains) and/or terminal access is limited. Thus, there is a need for more efficient systems and methods for treating of LNG cargo tanks.

SUMMARY

One or more embodiments of the invention describe systems and methods for gas-up and cool down of LNG cargo tanks while positioned in a waterway location. In some embodiments, a method for treating of LNG cargo tanks includes connecting a supply vessel and a receiving vessel using a manifold conduit, wherein the supply vessel is in a waterway location and wherein the receiving vessel is in the waterway location; gassing-up a cargo tank onboard the receiving vessel using natural gas from the supply vessel; cooling down the cargo tank onboard the receiving vessel using LNG from the supply vessel; transferring LNG from the supply vessel to the receiving vessel using ship-to-ship transfer; and disconnecting the supply vessel and the receiving vessel.

In certain embodiments, a method for treating one or more liquefied natural gas (LNG) cargo tanks, includes coupling a supply vessel to one or more LNG cargo tanks onboard a receiving vessel using a manifold system, wherein the supply vessel and the receiving vessel are in a waterway location; providing natural gas from the supply vessel to at least one of the LNG cargo tanks such that inert gas is substantially displaced from at least one of the LNG cargo tanks; providing cooled natural gas from the supply vessel to at least one of the LNG cargo tanks containing natural gas to cool the LNG cargo tank to an average temperature of than about −100° C.; and transferring LNG from the supply vessel through the manifold conduit to the cooled LNG cargo tank on the receiving vessel.

In some embodiments, the waterway location is in open water. In certain embodiments, the supply vessel and/or the receiving vessel are at anchor. In further embodiments, the waterway location is alongside a jetty. In some embodiments, the waterway location is offshore.

In some embodiments, a system for treatment of one or more LNG cargo tanks includes a manifold conduit, wherein the manifold conduit mechanically couples a supply vessel to a receiving vessel, wherein the receiving vessel is located in a waterway location, wherein the supply vessel is located in a waterway location and the supply vessel transfers natural gas to the receiving vessel using the manifold conduit such that inert gas in one or more LNG cargo tanks on the receiving vessel is substantially displaced and the LNG cargo tank is cooled, and wherein the supply vessel transfers additional LNG to the receiving vessel using the manifold conduit.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
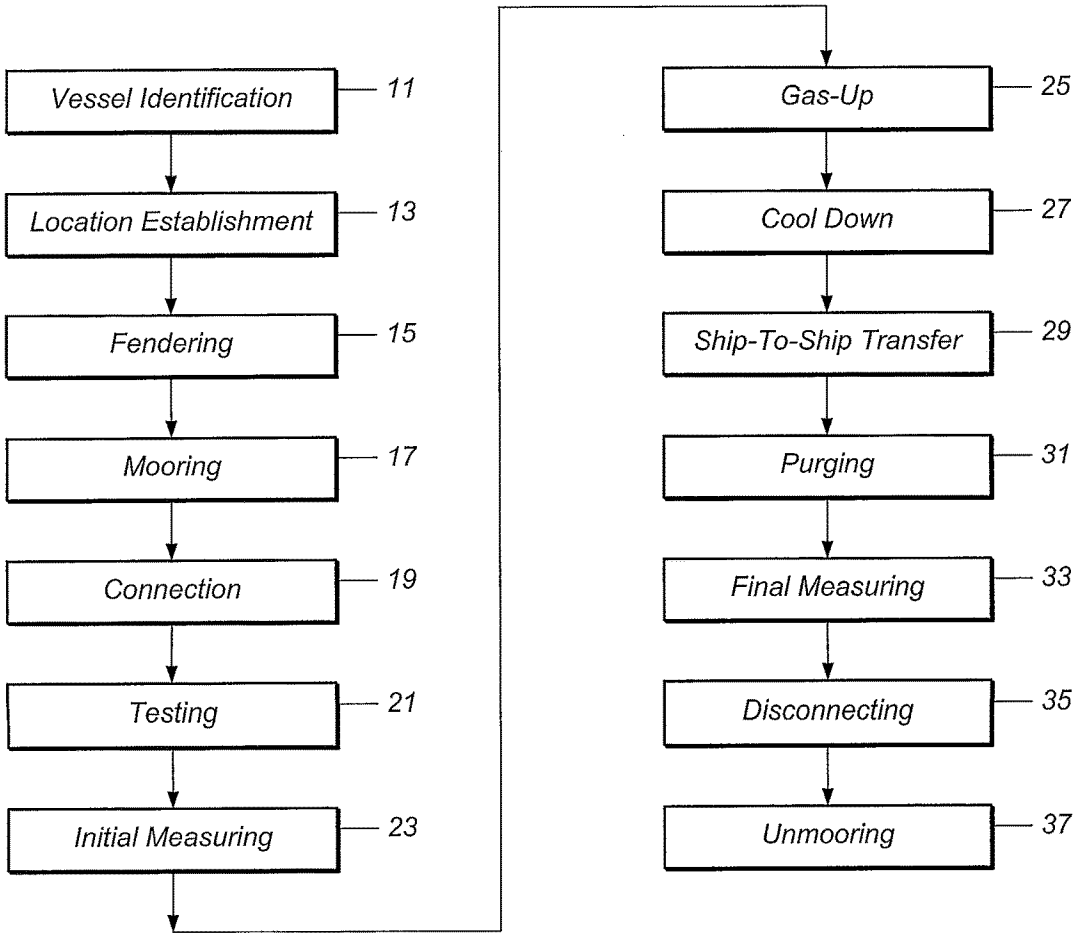
FIG. 1 is a flowchart of an embodiment of a method for gas-up and cool down of LNG cargo tanks located in a waterway location.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

Systems and methods for gas-up and cool down of LNG cargo tanks floating in a waterway location are described herein. The LNG cargo tanks may be onboard a ship located in the waterway location. In other instances, specific features, quantities, or measurements well known to those of ordinary skill in the art have not been described in detail so as not to obscure the invention.

"Coupled" refers to either a direct connection or an indirect connection (for example, at least one intervening connections) between one or more objects or components.

"Gas-up" refers to the displacement of an inert gas atmosphere in a cargo tank and piping systems with natural gas.

"Cool down" refers to reducing the temperature of the cargo tank atmosphere and surrounding containment after gas-up and prior to loading LNG.

"Waterway location" refers to any location in a navigable body of water, including but not limited to, offshore, alongside a jetty, at anchor or in open water.

"Jetty" refers to a structure extending into a sea, lake, river or other navigable body of water.

Using the systems and methods described herein, gas-up and cool down of LNG cargo tanks may be performed without the need for the LNG vessel to dock at port and/or a conventional LNG terminal. Gas-up and cool down of LNG cargo tanks in a waterway location makes ports and/or conventional LNG terminals available for shipping and transporting operations as compared to conventional a gas-up and cool down operation which occupies dock space. Thus, the economics of port operations and availability of ports are enhanced.

In some embodiments, gassing-up and cooling down of the LNG cargo tanks may take place in open water, at anchor, alongside a jetty, at a fixed floating facility or at any other waterway location. In certain embodiments, gassing-up and cooling down of the LNG cargo tanks takes place immediately prior to ship-to-ship transfer of LNG. In some embodiments, any vessel or platform capable of transporting or storing LNG, such as a regasification vessel, LNG carrier, LNG barge, coaster or floating platform may be used as either a supply vessel or receiving vessel. The supply and/or receiving vessel may be capable of onboard regasification of LNG. Examples of suitable systems for regasification of LNG are described in U.S. Pat. No. 7,484,371 to Nierenberg; U.S. Pat. No. 7,293,600 to Nierenberg; U.S. Pat. No. 7,219,502 to Nierenberg; U.S. Pat. No. 6,688,114 to Nierenberg; and U.S. Pat. No. 6,598,408 to Nierenberg.

FIG. 1 depicts a flowchart of an embodiment of a method for conducting gas-up and cool down of LNG cargo tanks in a waterway location. In vessel identification step 11, a supply vessel and a receiving vessel may be identified. The supply vessel may contain an LNG and/or gaseous natural gas cargo, and the receiving vessel may have LNG cargo tanks that require gassing-up and cooling down, and/or be in need of LNG cargo. The supply vessel and/or receiving vessel may be an LNG regasification vessel, an LNG carrier, an LNG barge, an LNG coaster, a floating platform or some other platform or vessel capable of storing and/or transporting LNG and well known to those of skill in the art. The supply vessel and/or receiving vessel may be double hulled and include at least one insulated cryogenic LNG cargo tank, which may store LNG at about −162° C. Pressure in the cargo tank(s) may be kept constant by allowing boil off gas to escape from the storage tank. Examples of cargo tanks include, but are not limited to, reinforced No. 96 type membrane tanks (Gaztransport & Technigaz SA of Saint-Rémy-les-Chevreuse, France). SPB prismatic tanks (IHI Corporation of Tokyo, Japan, Moss), spherical tanks (Moss Maritime AS of Lysaker, Norway), GTT MKIII tanks (Gaztransport & Technigaz SA of Saint-Rémy-les-Chevreuse, France), and/or cylindrical bullet tanks. In some embodiments, vessel identification step 11 may include a compatibility study to determine whether the supply vessel and receiving vessel are compatible with each other for the floating gas-up and cool down procedures.

In location establishment step 13, a suitable site location may be established. The suitable site location may be a waterway location, such as offshore, in open water, at anchor, alongside a jetty or at a fixed floating facility. For example, a suitable site may be a waterway inland of a port. Supply vessel location, receiving vessel location, vessel size, LNG delivery and pickup locations, water depth and/or any required permissions or permits may be taken into consideration in determining a suitable site location.

Figure 2A:
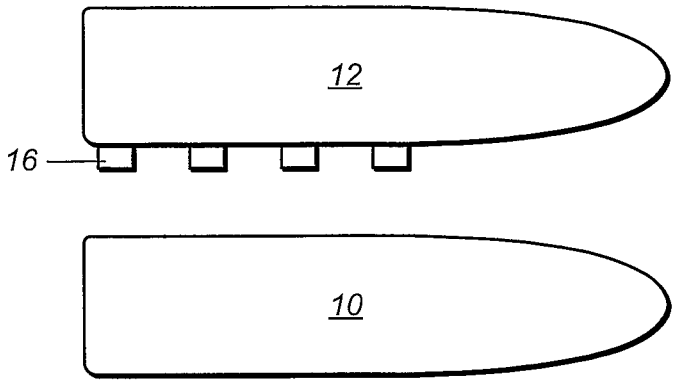
FIGS. 2A and 2B are schematic representations of an embodiment of fendering-up a receiving vessel and a supply vessel using ship-to-ship transfer equipment.
Figure 2B:
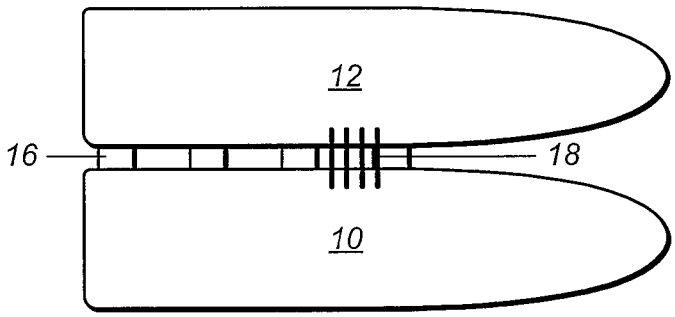

In fendering step 15, fenders are positioned between the vessels to inhibit the vessels from damaging each other. FIGS. 2A and 2B depict schematics of an embodiment of fendering two ships. Supply vessel 12 includes fenders 16. Fenders 16 may be floating pneumatic fenders, floating foam elastomeric fenders or other fenders suitable to prevent damage to the vessels to be coupled. Receiving vessel 10 may approach supply vessel 12 until fenders 16 are positioned between the two vessels and the vessels are fendered-up with ship-to-ship transfer gear 18.

In mooring step 17, the supply vessel and receiving vessel may be moored. In some embodiments, the vessels are moored at anchor, at open water, alongside a jetty, or at a fixed facility. In certain embodiments, supply vessel and receiving vessel are moored together. Supply vessel and/or receiving vessel may be fastened using ropes, mooring lines, hawsers, fenders, anchors, and/or buoys. Additional safety features may also be included in the mooring systems. For example, the mooring system may include mooring line hooks with load sensors, automated mooring strain gauge systems with alarms, remote release capabilities and/or quick release capabilities. In addition, provisions for tug boat assistance during mooring and timely access to tugs during periods of bad weather may be incorporated and improve the safety of the mooring system. Recommendations from Hazard Operability Studies (HAZOP) and Hazard Identification (HAZID) risk assessments may also be included in the mooring systems.

Figure 3:
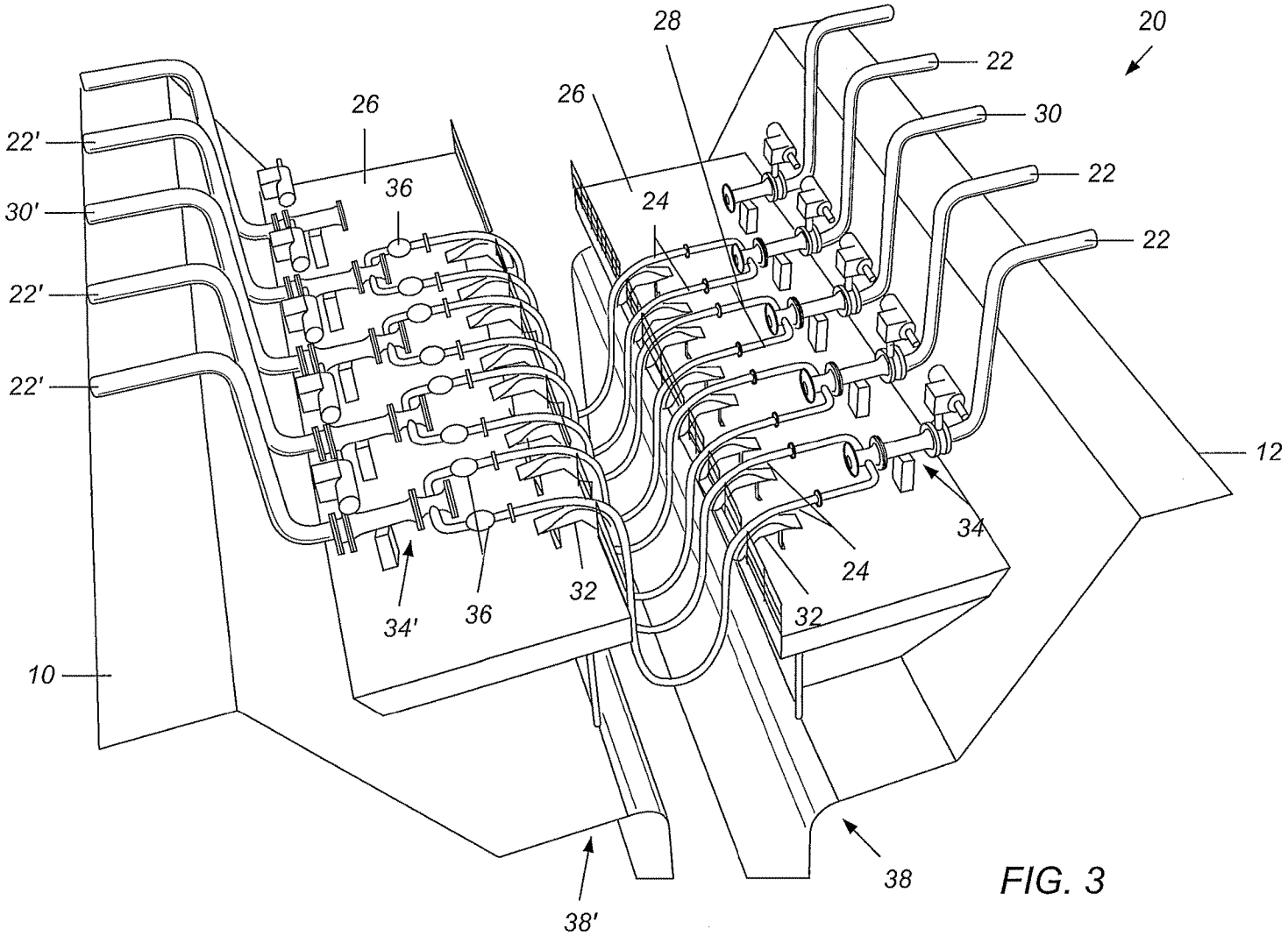
FIG. 3 is a schematic of an embodiment of a manifold system for gas-up and cool down of LNG cargo tanks and ship-to-ship transfer of LNG.

At connection step 19, a manifold system may be rigged and connected, linking supply vessel and receiving vessel. The manifold system may include cryogenic manifold conduits and saddles. Various arrangements of manifold conduits such as piping, hard arms, hoses, rigid connections and/or flexible connections may be used. The manifold conduits may be liquid or vapor flexible or rigid hoses or piping suitable for transferring LNG or gaseous natural gas, as appropriate. The number of liquid and vapor manifold may depend upon the amount of LNG to be transferred. In certain embodiments, one vapor and two liquid hoses may be used. FIG. 3 depicts an embodiment of a manifold system described herein, which may be used during connection step 19.

Emergency shut down tests may be made in testing step 21. The manifold system linking the supply vessel and receiving vessel may include one or more systems for quick release of the manifold conduit(s) between the two vessels, which may be tested at testing step 21. Systems for quick release of the connection are described herein (for example, FIGS. 4 and 5).

At initial measuring step 23, the LNG on the supply vessel may be measured prior to any transfer taking place, using a custody transfer measuring system well known to those of skill in the art.

Gas-up of the cargo tanks on the receiving vessel may be performed at gas-up step 25. At gas-up step 25, natural gas from the supply vessel, in either a gaseous phase or liquid phase, may be used to displace the inert gas atmosphere (for example, carbon dioxide) in the cargo tanks and piping systems of the receiving vessel. The natural gas from the supply vessel, may be stored as gaseous natural gas on the supply vessel, may be stored as LNG and regasified onboard the supply vessel prior to transfer, or may be regasified onboard the receiving vessel prior to transfer. Pumps or a pressure differential may be used to transfer the gaseous natural gas between vessels. The inert gas may be captured and treated, stored, and/or sequestered.

Cool down of the cargo tanks after the inert gas is displaced may occur at cool down step 27. During cool down step 27, the temperature of cargo tank containment systems onboard the receiving vessel may be reduced to less than about −100° C., less than about −140° C., or lower using LNG or cooled natural gas from the supply vessel, which has been transferred to the receiving vessel using a manifold system, such as the manifold system 20 and/or equipment described in connection step 19.

Ship-to-ship transfer of LNG may take place at ship-to-ship transfer step 29. LNG transfer may be completed using the manifold system of connection step 19 and/or manifold system 20 and/or pumps.

Nitrogen purging may occur at purging step 31. The final measuring of LNG onboard the supply and/or receiving vessel may take place at final measuring step 33 using a custody transfer measuring system well known to those of skill in the art. This final measurement of LNG may be used along with the initial measurement obtained in initial measuring step 23 to determine the volume of LNG transferred from the supply ship to the receiving ship. The ships may then be disconnected and unmoored at disconnecting step 35 and unmooring step 37.

FIG. 3 depicts a representation of an embodiment of a manifold system for ship-to-ship transfer, which may be used for floating gas-up and cool down procedures, as well as for ship-to-ship transfer of LNG. In manifold system 20, LNG may flow from an LNG storage tank on supply vessel 12 through liquid conduits 22. Liquid conduits 22 may be coupled to liquid hoses 24. The LNG may be transferred from liquid conduits 22 to liquid hoses 24 and flows to receiving vessel 10 via liquid conduit 22'. Deck 26 supports liquid hoses 24 and vapor hoses 28. Vapor hoses 28 may be coupled to vapor conduits 30 and 30'. Vapor conduits 30 and 30' and vapor hoses 28 help manage boil-off gas generated as LNG may be transferred through liquid conduits 22.

Liquid hoses 24 may contain stainless steel end fittings, be epoxy filled and swaged, and type approved by class for ship-to-ship transfer of LNG. Liquid hoses 24 may also contain layers of synthetic (for example, polyethylene) films and fabrics and be configured to withstand cryogenic cycles and to leak before failure. In some embodiments, liquid hoses 24 may be composite hoses of a nominal 8 inches (about 20.32 cm) in diameter, 15 meters in length, and have a 0.65 meter to 0.9 meter bend radius. Liquid hoses 24 may be supported by hose support saddles 32 on each of vessels 10 and 12.

Liquid hoses 24 and vapor hoses 28 may be positioned in hose support saddles 32. Saddles 32 may provide protection and support for liquid hoses 24 and vapor hoses 28 and maintain the minimum bend radius of the hoses. In addition, saddles 32 may transfer static and dynamic loads from liquid hoses 24 and vapor hoses 28 to the manifold deck structure on vessels 10 and 12 and provide chafe protection for the hoses.

Liquid hoses 24 may connect to liquid conduits 22, 22' using spool pieces 34, 34'. In addition, vapor hoses 28 may connect to vapor conduits 30, 30' using spool pieces 34, 34'. Spool pieces 34, 34' may reduce the diameter of the pipe to match the diameter of the hose connections as compared connections made using conventional pipe and hose connectors. For example, using spool pieces 34 liquid hoses 24 may be connected to liquid conduits 22, 22' and/or vapor hoses 28 may be connected to vapor conduits 30, 30' at angles less than 45 degrees. Using spool pieces 34, 34' may allow an increased number of hoses and/or conduits to be used in manifold system 20 as compared to conventional LNG manifold systems.

Release couplings 36 may be positioned between liquid hoses 24 and spool pieces 34' and/or between vapor hoses 28 and spool pieces 34'. Release couplings 36 may allow for liquid hoses 24 and/or vapor hoses 28 to quickly disconnect in emergency situations. Release couplings 36 may be operated remotely and/or automatically and provide for a 'dry break' designed to minimize a LNG leak or release upon actuation of the release coupling. Release couplings 36 may be actuated by a dry break actuator 50, shown in FIG. 5. In some embodiments, a mechanical/hydraulic system may be used to detect the need and trigger a release or separation. In some embodiments a radio communication and pneumatic stored pressure actuation system may be used to detect the need and trigger a release or separation, such as the system shown in FIG. 4.

Manifold system 20 may include water bath systems 78, 78'. Water bath system 78 may protect trunk decks and cargo tanks of vessels 10 and 12 from cryogenic damage to steel works caused by accidental release of LNG. Water bath systems 78, 78' may include a water bath on the main deck of the vessels under the manifold area and an additional water curtain under each manifold to protect the slopes of the proximal cargo tanks.

Figure 4:
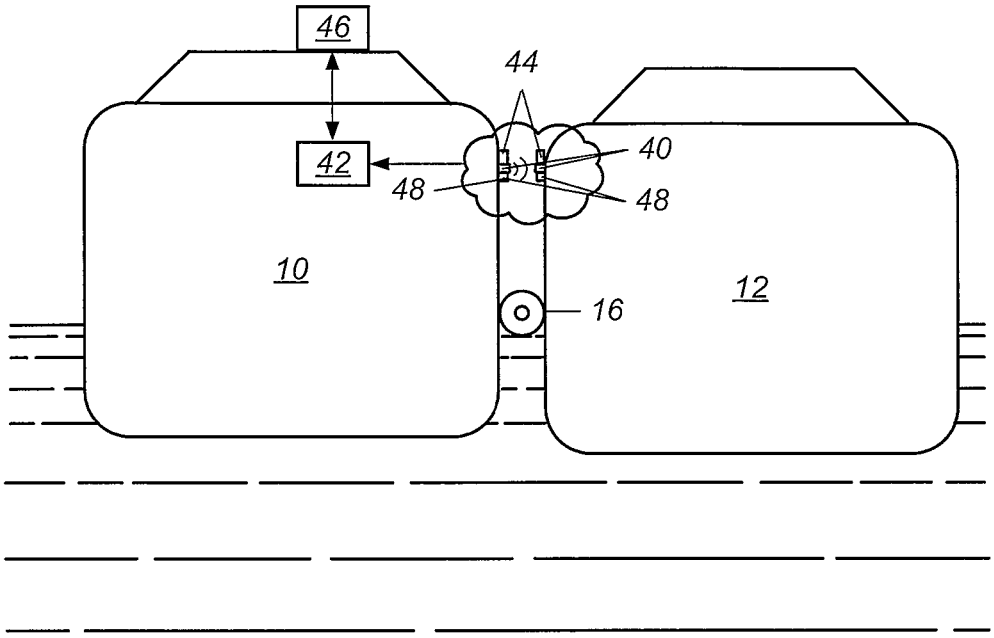
FIG. 4 is a schematic of an embodiment of a system to initiate quick release of a manifold conduit.

FIG. 4 depicts a schematic of an embodiment of a system to initiate quick release of a manifold conduit. To improve safety, the supply vessel 12 and/or the receiving vessel 10, may be equipped with an alarm set point to warn of an excursion of supply vessel 12 or receiving vessel 10 from the approved operating envelop of the two vessels when moored. Receiving vessel 10, supply vessel 12 and/or a manifold conduit may also be equipped with manual or automated quick release capabilities to close valves on a manifold conduit and decouple receiving vessel 10 from supply vessel 12 if either moves past the alarm set points. In some embodiments a mechanical or hydraulic system may be used to trigger a separation in such an emergency. In certain embodiments, physical connections, radio, laser or ultrasonic transponders may be used to measure the distance between a sending location (for example, supply vessel 12) and a receiving location (for example, receiving vessel 10) and thereby detect abnormal motion between the vessels.

As shown in FIG. 4, transponders 40 may be battery powered and/or attached to receiving vessel 10 and/or supply vessel 12 using heavy duty magnets, vacuum suction cups or some other attachment mechanism that can withstand seawater, wind, cold or other extreme conditions. Backup battery 48 may also be included. In some embodiments, multiple pairs of transponders that implement a voting system may be used to determine whether there has been abnormal movement of the ship. In some embodiments, fender 16 may also assist in keeping receiving vessel 10 and/or supply vessel 12 within normal parameters. As shown in FIG. 3, in some embodiments, transponders 40 send information to computer 42 onboard receiving and/or supply vessel 10 or to a programmable logic controller ("PLC") on a portable or fixed control console using low power radio transmitter 44. Computer 42 or a PLC may then analyze the data from the transponders, including the distance between hulls, rate of change, degree of rolling, yaw and pitching to determine whether abnormal motion is occurring, and trigger an audible and/or visual alarm in a control room, on a control console and/or on the open decks of receiving vessel 10 and/or supply vessel 12, for example alarm 46, when it receives the appropriate input. Computer 42 may communicate with alarm 46 using a wireless or wired connection. In some embodiments, the computer or PLC may be programmed to understand the parameters for normal movement of a ship and unacceptable deviation from those parameters. In some embodiments, computer 42 may determine that a distance between hulls has deviated from one or more preset parameters for a preset duration of time. Transponders 40 and other equipment in the field or on deck of receiving vessel 10 and/or supply vessel 12 used for detection and triggering of a need for emergency shutdown and decoupling of gas conduit 52 described herein are significantly safer than conventional methods. Conventional methods require mechanical and/or hydraulic connections which may be unwieldy and can present safety and/or environmental hazards.

In some embodiments, emergency release couplings on receiving vessel 10 and/or supply vessel 12 may be used alone or in conjunction with emergency shutdown and quick release connections on the manifold conduit (for example, release coupling 36). In some embodiments, a physical or hydraulic system may be used on the deck of receiving vessel 10 or supply vessel 12 for this purpose. In certain embodiments, radio communication and pneumatic or stored pressure actuation systems may be used on emergency shut down and dry break actuator 50, which may be release coupling 36. FIG. 4 depicts a schematic of an embodiment of a system to provide radio communication and pneumatic actuation systems to trigger emergency shut down and emergency release couplings on the deck of a vessel or on a manifold conduit. When audible and/or visual alarm 46 is activated, an operator (if present) can choose to send one or more radio signals or other type of signal to one or more dry break ERC actuators, such as dry break actuator 50, which may be attached to the manifold. The signal may be sent by a computer in a control room, such as computer 42, or on a fixed or portable control cart. One or more radio frequencies may be used to trigger one or more dry break ERC actuators individually, consecutively or simultaneously, as needed. Dry break actuator 50 receives the signal with receiver 52 and may use a stored-pressure pneumatic system to trigger the release of dry break actuator 50 between receiving vessel 10 and supply vessel 12. If an operator is not present, then the system may be programmed to automatically signal the emergency shut down and/or dry break actuator 50 to release if alarm 46 remains activated for a predetermined amount of time, for example 20 seconds, 30 seconds or one minute. The release process may occur in two steps. First, cargo transfer may be shut down. Second, if the alarm continues, there may be a second signal to trigger dry break actuator 50 on each hose, pipe, high pressure arm and/or manifold conduit. Receiver 52 may require receipt of multiple signals from the PLC or computer 42 before triggering release, in order to first confirm that cargo transfer is shut down prior to initiating the release on the couplings. Alternatively, the communication equipment attached to dry break actuator 50 may engage in two way communications with the PLC or computer 42. The radio communication and pneumatic actuation method and system described herein increases the safety as compared to conventional methods.

Figure 5:
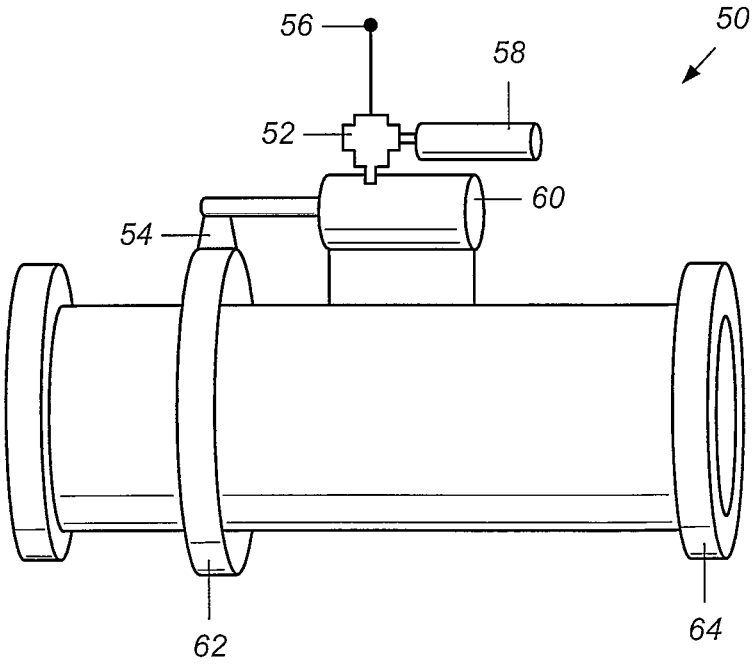
FIG. 5 is a schematic of an embodiment of a system to provide a radio communication and pneumatic actuation system to trigger emergency shut down and emergency release couplings.

As shown in FIG. 5, once receiver 52 obtains a signal to commence a release on coupling 54, receiver 52 with antenna 56, punctures attached compressed nitrogen gas cylinder 58. Receiver 52 may also include a solenoid valve and blowdown. In this embodiment, the change in pressure causes pneumatic cylinder 60 with a piston to move and coupling 54 to open, disconnecting from ERC collar 62 and allowing separation of the connections between receiving vessel 10 and supply vessel transfer piping 64 (for example, liquid hoses 24 and vapor hoses 28 shown in FIG. 3). The quick release/emergency release system described herein may also be used in connection with rigid or flexible piping, hoses, loading/unloading gas arms, high pressure arms, and/or liquid arms between two vessels, between a LNG carrier and a dock, or between any vessels, vehicles or structures used for cargo transfers such as transfers of high pressure gas or LNG.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. In addition, it is to be understood that features described herein independently may, in certain embodiments, be combined.

The invention claimed is:

1. A method for treating one or more liquefied natural gas (LNG) cargo tanks comprising:

connecting a supply vessel and a receiving vessel using a manifold conduit, wherein the supply vessel is in an open water location and the receiving vessel is in the open water location;

gassing-up at least one cryogenic cargo tank onboard the receiving vessel using the manifold conduit and natural gas from the supply vessel at a pressure differential, wherein the natural gas for gassing-up is in a liquid phase when transferred through the manifold conduit, is regasified onboard the receiving vessel and used in a gaseous phase during gassing-up;

cooling down the gassed-up at least one cryogenic cargo tank onboard the receiving vessel using LNG transferred from the supply vessel;

transferring LNG cargo from the supply vessel to the cooled down at least one cryogenic cargo tank onboard the receiving vessel using ship-to-ship transfer; and disconnecting one of the supply vessel, the receiving vessel or a combination thereof from the manifold conduit.

2. The method of claim 1, wherein the supply vessel and the receiving vessel are at anchor.

3. The method of claim 1, further comprising regasifying a portion of the LNG cargo onboard the receiving vessel.

4. A method for treating one or more liquefied natural gas (LNG) cargo tanks comprising:

coupling a supply vessel to at least one LNG cargo tank onboard a receiving vessel using a manifold conduit, wherein the supply vessel and the receiving vessel are in an open water location;

gassing up the at least one LNG cargo tank on the receiving vessel using LNG from the supply vessel, the LNG from the supply vessel regasified onboard the receiving vessel for use in gassing up, and employing a pressure differential such that inert gas in the at least one LNG cargo tank is displaced by the regasified LNG;

cooling down the at least one LNG cargo tank using LNG from the supply vessel until the at least one LNG cargo tank is cooled to an average temperature of less than about −100 ° C.; and transferring a remainder of LNG from the supply vessel through the manifold conduit to the cooled down at least one LNG cargo tank on the receiving vessel.

5. A system for treating one or more liquefied natural gas (LNG) cryogenic cargo tanks, comprising:

a manifold conduit, wherein the manifold conduit mechanically couples a supply vessel to a receiving vessel, the manifold conduit comprising at least one flexible liquid hose extending between the supply vessel and the receiving vessel;

a releasable coupling system configured to trigger emergency shutdown and release couplings, the release couplings coupled to the manifold conduit such that the release couplings are positioned between the at least one flexible liquid hose and a spool piece;

one or more LNG cargo tanks on the receiving vessel containing an inert gas;

a regasification system on the receiving vessel;

wherein the supply vessel transfers LNG to the receiving vessel using the at least one flexible liquid hose such that inert gas in the one or more LNG cargo tanks on the receiving vessel is displaced by transferred LNG regasified on the receiving vessel to gas up the one or more LNG cargo tanks, wherein the supply vessel transfers LNG to the receiving vessel using the at least one flexible liquid hose such that boil-off gas is generated;

the manifold conduit further comprising at least one vapor hose extending between the supply vessel and the receiving vessel, the at least one vapor hose removing boil-off gas generated as the one or more LNG cargo tanks are cooled down, the at least one vapor hose also connected to the releasable coupling system; and wherein the receiving vessel and the supply vessel are located in an open water location, and wherein the supply vessel transfers additional LNG to the receiving vessel using the manifold conduit.

6. The system of claim 5, wherein the releasable coupling system further comprises a dry break actuator.

7. The system of claim 5, wherein the releasable coupling system is tested before transferring LNG to the receiving vessel.

* * * * *